US005220747A

United States Patent [19]

Cherry et al.

[11] Patent Number: 5,220,747

[45] Date of Patent: Jun. 22, 1993

[54] REFRIGERATOR DOOR BIASING MECHANISM

[75] Inventors: David N. Cherry; Kermit B. Keeling, Jr.; Garland W. Insko, all of Louisville, Ky.

[73] Assignee: General Electric Company, Louisville, Ky.

[21] Appl. No.: 967,273

[22] Filed: Oct. 27, 1992

[51] Int. Cl.[5] ..... E05F 1/10; F24C 15/04; E05D 11/10

[52] U.S. Cl. ..... 49/386; 16/344; 126/191; 126/194; 248/417

[58] Field of Search ..... 49/386; 16/65, 291, 16/344, 345; 126/191, 192, 194; 248/417

[56] References Cited

U.S. PATENT DOCUMENTS

| | | | |
|---|---|---|---|
| 3,003,495 | 10/1961 | Coultrip | 126/194 |
| 3,250,267 | 5/1966 | Fry | 126/194 |
| 3,388,954 | 6/1968 | Smith | 49/386 |
| 3,842,542 | 10/1974 | White et al. | 49/386 |
| 3,980,856 | 9/1976 | Allen et al. | 126/194 X |
| 4,096,602 | 6/1978 | Nelson | 126/194 X |
| 4,138,988 | 2/1979 | Hurley | 49/386 X |
| 4,287,873 | 9/1981 | Goins et al. | 49/386 X |
| 4,315,495 | 2/1982 | Jellies | 49/386 X |
| 4,665,892 | 5/1987 | Spargo et al. | 49/386 X |
| 4,690,468 | 9/1987 | Lau | 312/291 |
| 4,742,598 | 5/1988 | Bruneau | 16/286 |
| 4,817,240 | 4/1989 | Sovis, Jr. et al. | 16/344 X |
| 5,027,473 | 7/1991 | Hottmann | 16/286 |

FOREIGN PATENT DOCUMENTS

| | | | |
|---|---|---|---|
| 705290 | 4/1966 | Italy | 49/386 |
| 657388 | 9/1951 | United Kingdom . | |

*Primary Examiner*—Peter M. Cuomo
*Assistant Examiner*—Michael Milano
*Attorney, Agent, or Firm*—Radford M. Reams; H. Neil Houser

[57] ABSTRACT

The biasing mechanism of a refrigerator includes a spring connected to provide biasing force in the desired directions at the appropriate degrees of door opening and an arm and roller arrangement which compliments the action of the spring. Within about 30 degrees or so of its closed position the door is biased toward its closed position. From about 30 degrees to about 90 degrees of door opening the biasing mechanism slightly biases the door toward its open position. At about 90 degrees the door is stable and beyond about 90 degrees the mechanism provides an addition stable position.

5 Claims, 2 Drawing Sheets

REFRIGERATOR DOOR BIASING MECHANISM

BACKGROUND OF THE INVENTION

The present invention relates to household refrigerators and, more particularly, to an improved door biasing mechanism for such refrigerators.

It is desirable that the operation of the doors of domestic (household) refrigerators have several somewhat incompatible characteristics. First, the user often has both hands full when he/she wants to close the door. Therefore, he/she merely shoves the door, often with an elbow or hip. This can result in the door failing to firmly close. Thus, when the door is only partially open, perhaps up to 30–40 degrees, it is advantageous that the door be biased toward its closed position. In this way door closing will be assured even though the user does not firmly close it. Second, it is desirable for the user not to have to hold the door when putting items into or taking items out of the refrigerator. Thus, it is desirable that the door be stable in one or more "fully open" positions. For example many users like for the door to stay at about 90 degrees, that is generally perpendicular to the front of the cabinet, and to be stable at another, more open, position, perhaps at about 130–140 degrees from closed or even at about 180 degrees from closed. It also is desirable that the door be easily movable between its various positions. Accomplishing the various operational characteristics of refrigerator doors is complicated and has become more so as refrigerators have become larger and the doors have been provided with deeper, and thus larger, storage shelves and bins. In the past many refrigerators used gravity to assist in accomplishing the desired operations. However, as the loads on the doors have increased, gravity enhanced movement has become too forceful. Also a number of large refrigerators are now designed to be mounted flush with the surrounding kitchen cabinets. This means that the refrigerators must be mounted with the doors vertical. They also must be mounted so their fronts will be even with the front of the cabinets. When the door is truly vertical there is no gravity assist to the door movement.

SUMMARY OF THE INVENTION

It is an object of the present invention to provide a household refrigerator with an improved door biasing mechanism.

It is a further object to provide such a mechanism which provides various operational characteristics of benefit to users of modern refrigerators.

The present invention provides an improved operation of refrigerator doors. Within about 30 degrees or so of closed the door is biased toward its closed position. From about 30 degrees to about 90 degrees the biasing mechanism slightly assists opening of the door. At about 90 degrees the door is stable and beyond about 90 degrees the mechanism provides an addition stable position and a solid door stop. The biasing mechanism includes a spring connected to provide biasing force in the desired directions at the appropriate degrees of door opening and an arm and roller arrangement which compliments the biasing action of the spring.

Other objects and advantages of the present invention will become apparent from the following detailed description, drawings and claims.

DESCRIPTION OF THE PREFERRED EMBODIMENTS

Figures 1, 2, 3, 4:
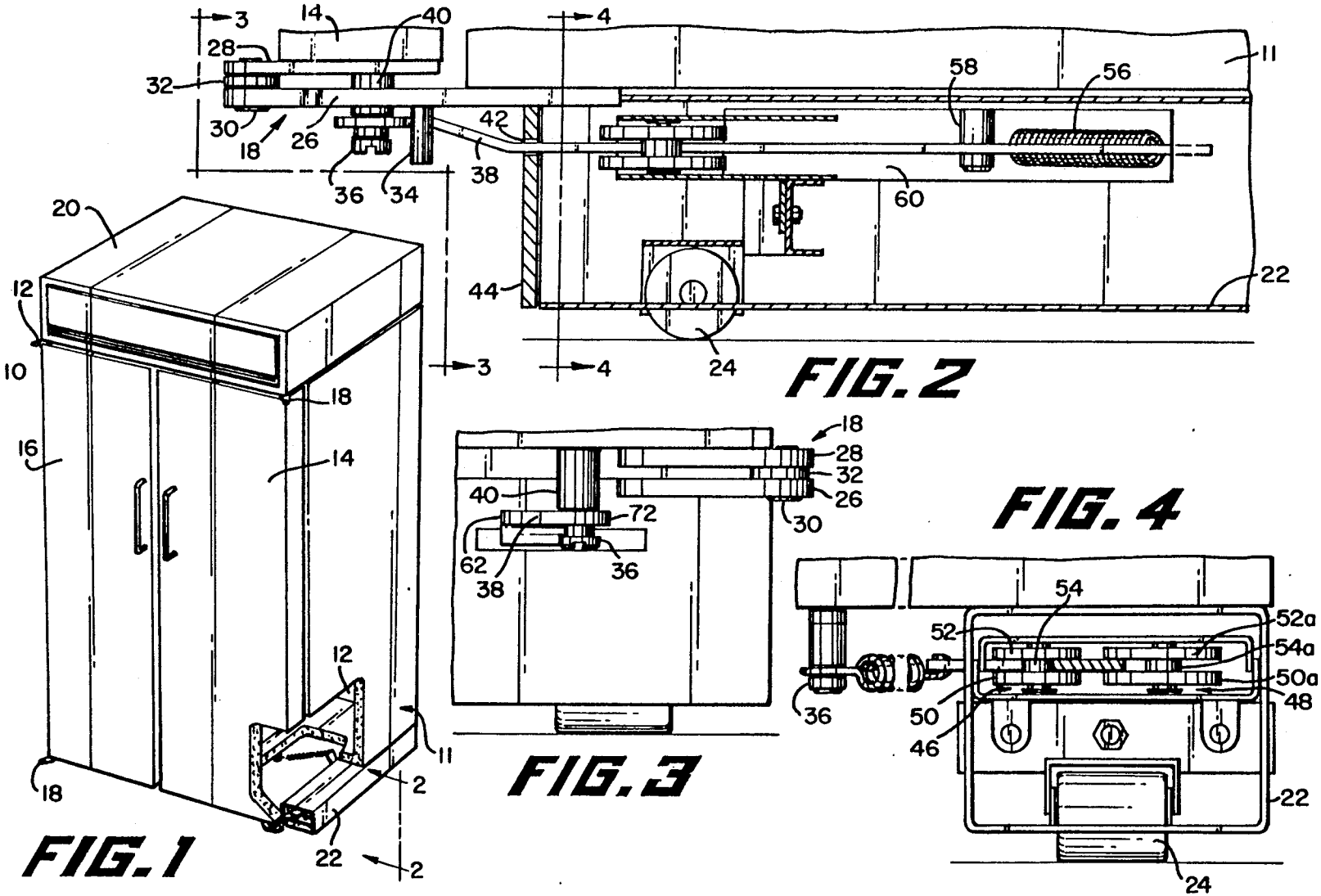
FIG. 1 is a front perspective view of a household refrigerator incorporating one embodiment of the present invention, the view being partially broken away.
FIG. 2 is a cross sectional view generally as taken along line 2–2 in FIG. 1 and showing one embodiment of the biasing mechanism.
FIG. 3 is a cross sectional view as taken along line 3—3 in FIG. 2.
FIG. 4 is a cross sectional view as taken along line 4—4 in FIG. 2.

Referring now particularly to FIG. 1, there is shown, in simplified form, a refrigerator 10 including a cabinet 11 defining a fresh food compartment 12 and a freezer compartment, not shown, in side-by side relationship. Access to these compartments is provided by doors 14 and 16 respectively. The illustrative refrigerator 10 is a large unit and can be mounted flush with cabinets in a kitchen. To that end the doors 14 and 16 are pivotally mounted to the cabinet 11 by hinges 18, one at the outside upper and lower corners of each door. Each pair of hinges provides a vertical axis about which that door pivots in opening and closing. The hinges are "out board", that is the axis of door movement is laterally to the outside of and in front of the door so that the adjacent cabinets will not interfere with operation of the door. Also the machinery compartment 20 is positioned above the fresh food and freezer compartments.

Box like channel members 22 are attached to and extend front to rear along the lateral edges of the underside of the cabinet. Each channel mounts wheels 24, which support the refrigerator on a floor and a mechanism, not shown, for leveling the cabinet to compensate for any irregularity of the floor. Each channel member also mounts a biasing mechanism for assisting in desired operation of the corresponding door, as will be explained in more detail hereafter. While the biasing mechanism for the right hand door will be described, it will be understand that a mirror image mechanism will be provided for the left hand dcor. Furthermore, it will be understood that which of the freezer and fresh food compartments is on which side is purely a matter of choice.

Referring now particularly to FIG's 2–4, the hinge mechanism 18 at the lower corner of door 14 includes a base plate 26 attached to the bottom of cabinet 11 and a door plate 28 attached to the door. A pivot pin 30 is attached to the base plate 26 and extends through an opening, not shown, in the door plate and a low friction washer 32 is positioned around the pin between the plates. This pivotally mounts the bottom of the door to the cabinet and a similar hinge arrangement mounts the top of the door so that the door pivots or rotates about an axis defined by the pivot pins. A stop pin 34 is mounted to the base plate and projects downwardly at a position remote from the pivot pin 30 for purposes which will be described in detail hereafter.

A mounting post 36 is connected to the bottom of door 14 laterally inward of the pivot pin 30 and, in the illustrative embodiment, independently of the door plate 28. The outer end of an arm 38 is rotatably mounted about the post 36. A spacer 40 is positioned over the pin 30 between the door 14 and arm 38 and is sufficiently long to assure that the top of the arm is below the bottom of the base plate 26. The arm 38 is rectangular in cross section and elongated so that it projects through a slot 42 in appearance to plate 44 and extends into the channel member 22. As best seen in FIG's 5–8, the arm is irregular in configuration, as will be explained in more detail hereafter. The intermediate portion of arm 38 extends between a pair of rollers 46, 48. Roller 46 includes an upper flange 50 and a lower flange 52 joined by a central hub 54. Similarly roller 48 has a lower flange **50*a*, an upper flange 52*a* and a hub 54*a*. The flanges closely overlie the upper and lower surfaces of the arm 38 and assure that the arm stays flat and moves smoothly as the door 14** opens and closes.

A spring 56 exerts the various desired biasing forces to the arm 38 in its various positions between open and closed. To that end an anchor post 58 is mounted to the under side of the cabinet 11 in a position laterally inward of the arm 38 and forward of the inner end of the arm when the door is closed. One end of the spring 56 is connected to the post 58 and the other end of the spring is connected to the inner end of the arm 38. The spring/post connection is stationary in relation to the cabinet 11 while the spring/arm connection moves as the door opens and closes. A slot 60 is provided in the inner side of the channel member 22 and is long enough to accommodate the movement of the spring resulting from movement of the door.

Referring particularly to FIG's 5–8 it will be seen that the spring 56 continuously biases the arm 38 to rotate counter clockwise about pin 36 so that the left edge or lateral side 62 of the arm continuously engages the hub 54 of roller 46. The edge 62 is formed to cooperate with the hub 54 in a manner coordinated with the instantaneous biasing force of the spring on arm 38 for the desired operation of the door 14. More specifically, the side 62 includes two sharply angled or curved sections 63, 64 which form a detent or notch 65. Inwardly of the curved section 64 the side 62 includes an elongated straight section 66. The inward end of section 66 joins a short sharply angled or curved section 67. The junction of the sections 66 and 67 forms a second detent or notch 68. The section 67 joins a last sharply angled, but straight section 69 to form a nose 70.

Figure 5:
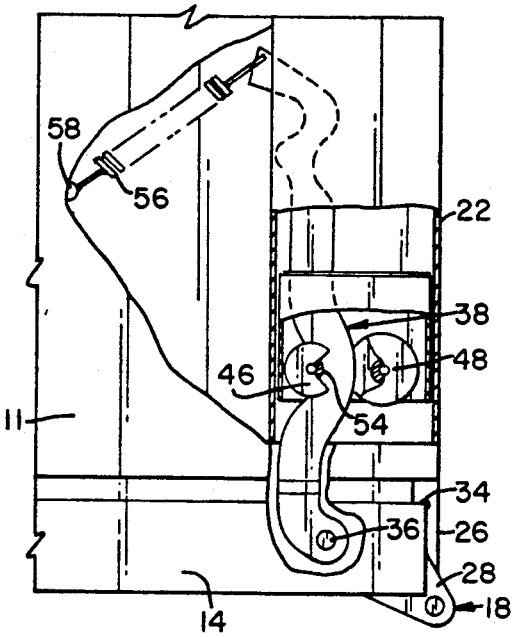
FIG. 5 is a schematic plain view, partly broken away and partly in section illustrating the door and biasing mechanism with the door in its fully closed position.

The hub 54 of roller 46 rests in detent 65 and releasably secures the door in its closed position (see FIG. 5). As the door is opened the hub 54 moves upwardly along the angled section 64 and the spring 56 is stretched (compare FIG's 5 and 6). During this movement of the door the spring biases or urges the door toward its closed position. Thus, if the door is released at any point along this part of its travel or is pushed from a more open position with enough force to get to this part of its path, then the force of the spring, together with the interaction of the roller and arm, will assure the door completely closes.

Figure 6:
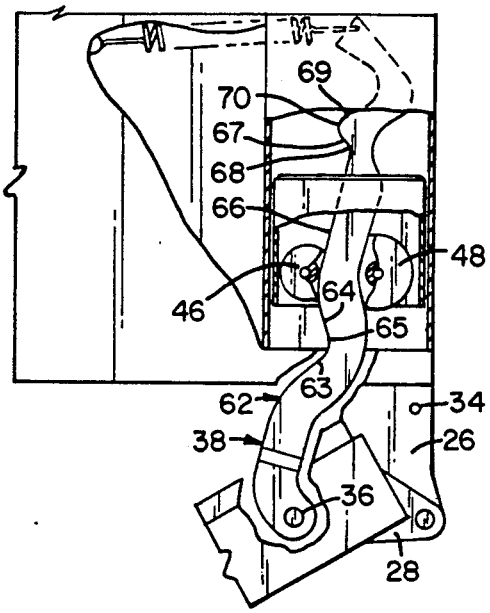
FIG. 6 is similar to FIG. 5 but with the door in a slightly open position.
Figure 7:
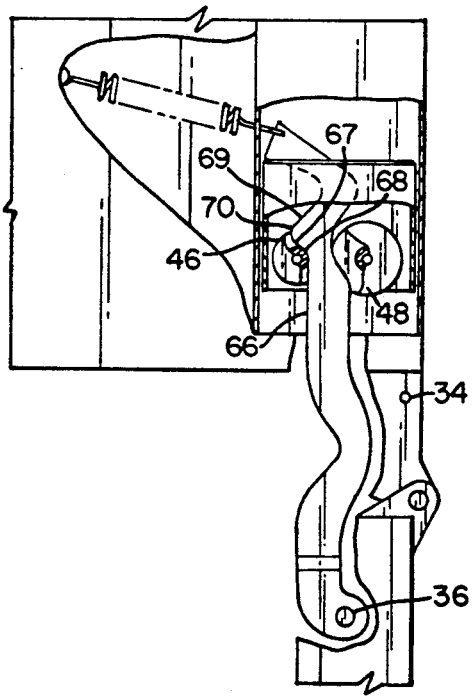
FIG. 7 is similar to FIG. 5 but with the door in a position perpendicular to the front of the cabinet.

In FIG. 6 the door is in an intermediate position, in the illustrative embodiment about 30 degrees open. The inner end of arm 38 is substantially even with the anchor post 58, that is they are equi-distant from the front of the refrigerator. The roller has moved off arm section 64 and is at the outer end of straight section 66. The straight section is angled away from the roller 46 so that the tendency is for the point of roller/arm contact to move toward detent 68. As the door moves from the position of FIG. 6 toward that of FIG. 7, the spring shortens and tension is released and the roller moves along arm 38 toward detent 68. During this portion of the door movement the door is not biased toward its closed position and, in the illustrative embodiment, is slightly biased or urged toward the "fully open" position of FIG. 7. In FIG. 7 the door is generally perpendicular or at 90 degrees to the front of the cabinet, the spring is in its shortest or most relaxed configuration and does not urge the door in either direction. The engagement of hub 54 in detent 68 releasably secures the door in this position.

Figure 8:
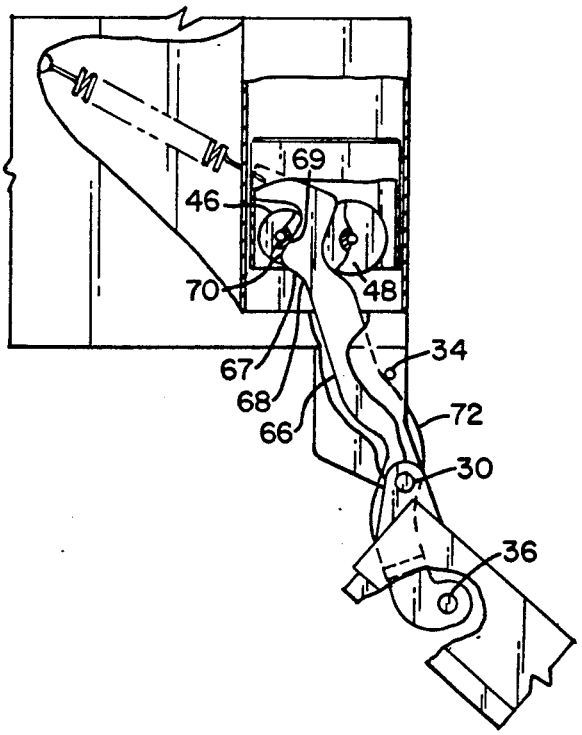
FIG. 8 is similar to FIG. 5 but with the door in a position beyond 90 degrees open against the stop.

As the door is moved beyond its perpendicular position, hub 54 rides up the sharply angled section 67 and over the nose 70 to the straight section 69. FIG. 8 illustrates the most fully open position of the door which, in the illustrative embodiment is about 130 degrees open. The connection of arm 38 to pin 36, contact of the right side 72 of arm 38 with stop pin 34 and engagement of roller hub 54 with section 69 of the left side of arm 38 cooperate to prevent any greater opening of the door 14. The spring is tensioned and is biasing the door toward its closed position. However, section 69 is oriented perpendicularly to the direction of the force applied by spring 56 and releasably secures the door in this most open position.

Closing the door requires a fair amount of applied force to move the roller off section 69, then the spring force and arm configuration bias the door to close to the perpendicular position (FIG. 7). Some slight force must be applied to then close the door to the position shown in FIG. 6. Finally, once the roller reaches the inner end of angled section 64 the door is strongly biased and will fully close without any additional external force being applied.

What is claimed is:

1. A household refrigerator including a cabinet defining a refrigerated space; a door for selectively closing said refrigerated space; hinges mounting the door for pivotal movement between open and closed positions relative to said cabinet; and a door biasing mechanism including:

an elongated arm having one end pivotally connected to said door at a position offset from the axis of pivotal movement of said door, said arm extending into said cabinet;

one end of said biasing spring having a stationary connection to said cabinet and the other end of said spring having a movable connection to the other end of said arm;

a first roller mounted to said cabinet, said spring biasing a portion of said arm into engagement with said roller;

said stationary spring connection being so positioned relative said movable spring connection that up to a first predetermined angle of door opening said spring biases said door toward its closed position, and the portion of said arm engaging said roller up to the first predetermined angle of door opening is shaped to assist door closing;

the stationary spring connection being so positioned relative to the movable spring connection that from said first predetermined angle of door opening up to a second predetermined angle of door opening said spring exerts no door closing bias force on said door, and the portion of said arm engaging said roller from said first to said second angle of door opening being shaped to assist door opening; and said stationary spring connection being so positioned relative to said movable spring connection that upon movement of said door beyond the second angle of door opening said spring biases said door toward its closed position.

2. A refrigerator as set forth in claim 1: wherein the portion of said arm engaging said roller at said second angle of door opening is formed as a detent releasably holding said door in that position.

3. A refrigerator as set forth in claim 1: wherein the portion of said arm engaging said roller upon said door moving beyond the second angle of door opening is formed as a nose shaped to deter unintentional closing of said door by the biasing force of said spring.

4. A refrigerator as set forth in claim 3: further including a stop, positioned to engage said arm after said door moves beyond the second angle of door opening so engagement of said stop with said arm together with engagement of said roller with said nose portion of said arm then prevents further opening of said door.

5. A refrigerator as set forth in claim 1, further including: a second roller mounted to said cabinet, said arm extending between said rollers for continuous engagement with said first roller.

* * * * *